United States Patent [19]

Kawamura et al.

[11] Patent Number: 4,958,678

[45] Date of Patent: Sep. 25, 1990

[54] METHOD FOR PRODUCING REINFORCED BLOCK MATERIAL OF METAL OR THE LIKE

[75] Inventors: Yuzo Kawamura; Sigeo Nakagawa, both of Otsu, Japan

[73] Assignees: Yugenkaisha Idearesearch, Shiga; Matsuo Sangyo Co., Ltd., Osaka, both of Japan

[21] Appl. No.: 288,892

[22] Filed: Dec. 23, 1988

[30] Foreign Application Priority Data

Dec. 27, 1987 [JP] Japan ..... 62-331843

[51] Int. Cl.[5] ..... B22D 11/00

[52] U.S. Cl. ..... 164/461; 164/463; 164/488; 164/900

[58] Field of Search ..... 164/461–463, 164/423, 488, 900

[56] References Cited

U.S. PATENT DOCUMENTS 4,523,625 6/1985 Ast ..... 164/461

FOREIGN PATENT DOCUMENTS 3442009 6/1985 Fed. Rep. of Germany ..... 164/463

*Primary Examiner*—Richard K. Seidel
*Assistant Examiner*—Edward A. Brown
*Attorney, Agent, or Firm*—Armstrong, Nikaido, Marmelstein, Kubovcik & Murray

[57] ABSTRACT

A method for producing a crystalline reinforced block material, wherein a crystalline material in molten state at a high temperature is laminated in thin film form on a base material. Heat is dissipated in the direction of the base material to rapidly cool the crystalline material. Simultaneously high pressure and large shearing force is applied to the crystalline material, as the material is cooled, by a pressing means to cool and solidify the crystalline material into a thin film form on the base material. Further laminates of the crystalline material in molten state at a high temperature are laminated in a thin film form on underlying thin layer surface in molten state or semisolidified state, one after the other on the immediately proceeding laminated thin layer. While dissipating heat in the direction of the underlying thin layer to rapidly cool the crystalline material, high pressure and large shearing force are simultaneously applied to the crystalline material being laminated to cool and solidify the crystalline material into a thin film form on the immediately proceeding laminated thin layer to unite, cool and solidify the applied laminate and form a block body of the crystalline material on the base material.

1 Claim, 8 Drawing Sheets

METHOD FOR PRODUCING REINFORCED BLOCK MATERIAL OF METAL OR THE LIKE

BACKGROUND OF THE INVENTION

1. Field of the Invention

The present invention relates to a method for producing a reinforced block material of a crystalline material such as a metal or the like. More particularly, the present invention relates to a method for producing a reinforced material of a metal or the like from a crystalline material such as a metal or the like which heretofore has been formed in fiber-like or film-like shape only by making it amorphous or crystallized in a miniaturised grain structure.

2. Description of the Prior Art

Although a crystalline material should have an excellent strength primarily normal to the crystal, this, heretofore can only be accomplished in practice in an extremely fine range. It is an important problem how to widen such range of ideal strength. For example, although a crystalline polymer has the potential to have a far larger strength than a metal, it has, in practice only achieved strength in the order of about 1/100 of its potential. In order to reinforce the strength of such polymer, it has been the practice to allow the molecules to be oriented by elongation under specified conditions and put the orientation of the crystal in order. In the case of a metal, it is in a state far from the ideal strength due to such causes as the lattice defects, dislocation, or intercrystalline weakening in the crystal grains. A method for bringing the strength of such metals closer to the ideal strength involves making the crystals needle-like (whisker) containing no dislocations, or making the crystal grains be miniaturised, or glass-like containing almost no crystal. As the methods generally known for making metal crystal grains miniaturised as mentioned above, there are such ones as the addition of a crystal grain miniaturising agent to the molten metal. Physical deformation of the bulk material by extrusion, forging, rolling, etc., or powder metallurgy utilizing rapidly cooled metal powders.

However, the reinforcing method such as, for example, by the elongation of crystalline polymers is limited in the case of fibers only, and the method for molding these into a block-like form has not been obtained. Also, in the case of a metal, neddle crystals (whisker) become very expensive in cost and can not be applied in the case of a large sized block material. The reinforcing of a metal by crystal grain miniaturization can be said to be an excellent reinforcing method as it accompanies no lowering of elongation properties found in other reinforcing methods. However, the addition of crystal miniaturising agents to a molten metal has a limit in the miniaturization ability, and is considerably influenced by the cooling rate of the molten metal. Also, because the procedures of extrusion, rolling, forging, and the like which were effected with the object of deforming and pulverising the already formed crystal grains formed by physically deforming a bulk material are effected for a coagulated metal, such procedures required very large energy and high cost, and the deformed crystal grains, when left as they are, take flat shape equally in most cases, so that anisotropy in strength. Moreover, cracks were apt to occur in the material due to the deformation, and the exhaustion of the die members are hastened. Further, in the powder metallurgical method, not only do the crystal grains recrystallised in practice in sintering become large to a certain extent, but also, powder metallurgy has many procedures requiring high cost, mature consideration is required in the utilization of such material as a raw metal material, not only from the raw material costs, but also in the application to molded articles.

SUMMARY OF THE INVENTION

The present invention provides a method for producing a reinforced block material of a metal or the like, in which the production procedure is simplified by enabling the molding of the material to a block-like shape lowering the production cost and enabling the application of the method to a molded article.

The present invention can be summarized as follows:

In order ot attain the above-described object, in the present invention a crystalline material such as a metal or the like in a molten state is laminated at a high temperature in a thin layer on a base material. A high pressure and a large shearing force are simultaneously applied to the molten material by pressing means with rapid cooling of the material by dissipating heat in the base material direction to let the metal be cooled and solidified together. A crystalline material is further laminated in a molten or solidified state on the surface of the thin layer material described above with high pressure and large shearing force simultaneously applied to the molten material, while dissipating heat in the direction of the above-described underlying thin layer material while rapidly cooling and solidifying such material on the upper surface of said underlying layer. By repeating the above-described steps, a block of the crystalline material is formed on the base material.

The method for producing a reinforced metal block material according to the present invention is such as described above. The material in a molten state formed on a base material in a thin layer form is rapidly cooled from the lower part thin layer contacted to said base material upward while rapidly dissipating heat to the direction of the base material contacted. Thus, the material is freezed and solidified and accompanied by the miniaturization of the crystal, miniaturization of the deposited layer, and widening of the solid solution range. By giving high pressure and large shearing stress on the material under solidification, the crystal grains of the crystalline material are divided into sections and miniaturized and prevented from recrystallization. A minute crystal structure is formed to produce reinforced thin films of the reinforced material on the base material.

By further laminating a material in a molten state on the upper surface of the above-described thin film while the surface of the thin film is in a molten or semisolidified state, such new thin film is cooled and solidified while dissipating heat in the direction of the underlying thin film. Strong deformation is given to the material under solidification by high pressure and large shearing stress by the pressing means to form a similar thin film on the underlying thin film. At this time, in the overlying thin film and the underlying thin film, atomic junction of both layers is effected, because lamination is effected while the surface of the underlying thin film is in a molten state or in a semisolidified state. Moreover, because the next material is laminated in a molten state to the surface of the underlying thin film which is in a state wherein the oxide film, adsorbed gas film, or the which would hinder the adhesion between overlying and underlying layers is not formed, and the deformation given by the pressing influences not only the layer under solidification, but also the thin layer positioned at the lower position thereof, the upper and lower layers are solidified as an undistinguishable unit. As described above, by laminating a crystalline material such as a metal in a molten state in a thin layer to be rapidly cooled and freeze solidified, and by giving large deformation to the material under solidification, miniaturization of crystals is effected to carry out the reinforcement of the material. While the surface of the material is in a molten or semisolidified state, a new material in a molten state is laminated onto the surface to unitedly form the thin film of a new reinforced material in the same manner as in the underlying thin layer. By repeating such steps as described above, multiple layers of the thin films of the reinforced material are molded as a whole block in which the boundary surface thereof is undistinguishable. Also, because the material is deformed by pressing means applied to the material in the semisolidified state before the underlying material in molten state is perfectly solidified, such a large energy as is required in deforming a bulk material in the solidified state is not necessary and large deformation can be given to the material by a considerably small energy.

As described above, according to the present invention, in producing a reinforced material by miniaturising the crystals of a crystalline material such as a metal or the like, by rapidly cooling the material in a molten state, and at the same time, by giving to this material in the semisolidified state large deformation with a considerably small deformation energy, the reinforcement of the material has been devised, and together with that, molding into a block form has been accomplished to simplify the production process and to make the reduction of production cost possible. Thus, the present invention can provide a method for producing a reinforced block material which can realize the application to molded products.

DETAILED EXPLANATION OF THE INVENTION

Figure 1:
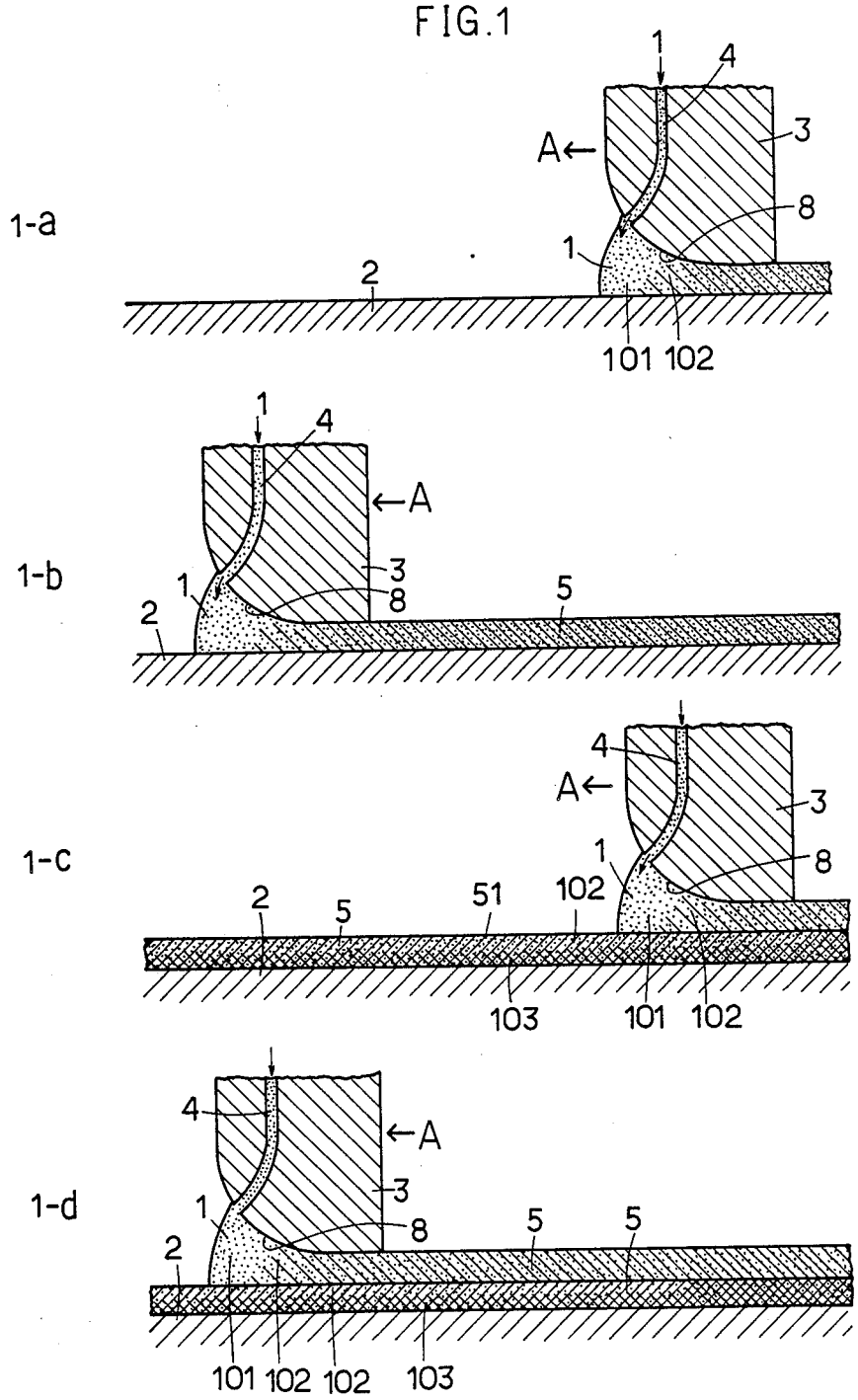
FIGS. 1*a*–1*d* and 2*a*–2*d* are the process explanatory diagrams showning processes for forming the reinforced block material in the method for producing a reinforced block material such as a metal or the like according to the present invention.

The present invention will be explained in more detail.

A crystalline material is changed from a fluid to a solid by making the glass transition temperature thereof as a boundary. Although this glass transition point temperature is a proper one for each kind of material, it has a range of change in dependence to the conditions at the time of the change. In order that a crystalline material in a solid state becomes fluidised, it is required to obtain energy, and in order that a crystalline material in a fluidised state becomes solidified, it is necessary to discharge energy. In a material which expands in solidification, this glass transition point temperature is lowered by pressure, and in a material which shrinks by solidification, the glass transition point temperature is raised by pressure. Therefore, large pressure and shearing force influence the glass transition point temperature of a crystalline material. Also, the temperature gradient in the cooling of a crystalline material in a fluidised state has a large influence in the crystallization, and the crystallization thereof is suppressed by effecting rapid cooling. Although the molecules of a crystalline polymer have random arrangement in a glass-like state, they lose freedom as they are cooled, and rapidly start to crystallize. In an extremely high viscous state in the state proceeding crystallization, by simultaneously giving large pressure and large shearing force, molecules are rapidly arranged in the direction of the shearing force and the material crystallises with rapid cooling. When the shearing force at this moment is one dimensional and linear, a close assembly of linear materials which develop maximum strength in the direction of the shearing force are formed. When the shearing force is two dimensional and in the plane direction, a film-like material having strength in the plane direction is formed. A metal has enormous lattice defects in a molten state. Although the lattice defects mutually unite and vanish in the case of solidification of the metal, when the solidification has been effected rapidly, the metal is solidified with the lattice defects held therein. A glass-like metal can be said to be the one holding many lattice defects due to such rapid solidification as mentioned above. Especially, in the inside of the metal, the regular arrangement of atoms, that is, the range of crystal is extremely limited, and the metal is formed as such as one having no long-distance, regularity. The case of a metal having extremely miniaturised crystal structure occurs in a cooling rate wherein the metal does not attain the glass-like metal as described above by the formation of a multiplicity of crystal nuclei. In the ordinary solidification of a metal, the thickness of the solidified layer is not so thin, and large pressure and shearing force are also not given thereon. In the case of such a thick solidified layer, the formation and growth of crystal nuclei are carried out partially, and, for example, the nuclei generated or initially grown only in the cooled surface adhere to the cooled surface as they are and grow further, or leave the cooled surface to diffuse in molten metal and grow. But, because the range of the diffusion thereof is wide and the part of generation is limited, it is difficult to make its amount large. Also, because the area of the heat transmitting surface is small, rapid cooling is difficultly effected and crystals are apt to become coarse.

One of the essential points of the present invention resides in that, in solidifying a crystalline material such as a metal or the like, the material under solidification is subjected to large deformation with a comparatively small energy by use of a pressing means, and the arrangement of molecules and atoms in the inside thereof are artificially controlled without being left under the option of natrue. The control of the arrangement of these molecules and atoms govern the characteristics of products. Further, another one of the essential points of the present invention is that the reinforced material laminated in thin layer construction is united into a body with a state undistingushable in the boundary surface of each layer, and can be obtained as a reinforced block material as a whole.

In the present invention, a crystalline material in a molten state at a high temperature is produced in a thin layer cconstruction capable of being rapidly cooled. Large deformation is given to the material by simultaneously giving high pressure and shearing force with the material in a semisolidified state by using a comparatively small energy to hinder the growth of the crystal grains and to let the miniaturised crystal construction be formed. Where the material is an aluminum-silicon alloy, the pressure in this moment prevents the segregation of silicon in the alloy and help the supercooling of the alloy. Thereofore, when the pressure has been released, a multiplicity of miniaturised silicon crystals are rapidly segregated to promote the crystal miniaturisation of the whole alloy. As the gradient of the cooling temperature becomes large, crystallisation is restrained and the resultant material approaches a glass-like metal. Also, the metal formed as a supersaturated solid solution effects minute crystal segregation by the aging effect and can reinforce the material. Also, in the case of an iron alloy or the like, it is also possible to reinforce the resultant material by giving large pressure and shearing deformation in the state of solid solution thereof to generate many dislocations and lattice defects. Although this is usually effected in a secondary procedure, it is not required in the present invention because it is carried out at the time of laminating the upper layer immediately after the solidification.

As described above, in the present invention, a material in a molten state at a high temperature is laminated in such a manner as to form a thin layer construction, and the resultant product is successively cooled from the part contacting the base material to the upper side thereof while rapidly dissipating heat to the side of the base material at a temperature in the neighborhood of the glass transition point temperature. The material becomes solidified while it is being given large artifitial molecular arrangement or atomic arrangement. In a semimolten state before the upper surface layer of this thin layer structure becomes perfectly freeze solidified, or in a remelted state by heat treatment giving thermal influence only to the upper surface of the thin layer structure having completed freeze solidification, a new molten material is laminated theron. And at the same time, large pressure and shearing force are simultaneously given by use of a pressing means. Then, the molten material newly laminated becomes solidified while rapidly being cooled and providing large artificial molecular arrangement or atomic arrangement in the semisolidified state at a temperature in the neighborhood of its glass transition temperature. In this case, the pressure and shearing force given by the pressing means influence not only the thin layer solidifying but also the base material or thin layer positioned thereunder to generate a multiplicity of dislocations or lattice defects and promote artificial molecular arrangement and atomic arrangement. As described above, since the newly laminated thin layer acts as a whole with the underlying thin layer, the boundary surface between the upper and lower two layers becomes undistinguishable. Thus, by repeating the laminating process onto the upper layer, a molded body in a block form can be formed.

Also, in the present invention, in the junction part between the previously laminated underlying thin layer and the thin layer to be laminated thereon, it is desired to effect the laminating process in a high vacuum closed space, in an inert gas, or during immersion in a molten hot metal in order to remove the contamination layer such as, for example, the existing oxide film, adsorbed gas film, etc. as much as possible. And is also desired that the material to be supplied is used after being sufficiently degassed, and the gas evolved in solidification is rapidly excluded. Moreover, the material in a molten state to be laminated on the newly formed solidified layer is preferably supplied as quickly as possible to repeat the lamination.

As in the present invention, a block-like reinforced material having miniaturised crystal structure is produced by repeating the process of newly forming a thin film of the reinforced material as a whole on a reinforced material formed in thin film structure, while the thin film surface thereof is in a molten state or in a semisolidified state to let the reinforced material grow to have block-like construction.

In one case of the method, when the thin film of the reinforced material formed previously dissipates heat in the direction of the base material or the thin film positioned in the under side and freeze solidied, the material is successively cooled from the base material or from the part contacting the under layer to upwards in the thin film structure, and when it is freeze solidified, and before the surface or the upper surface part of the thin film structure is perfectly cooled and freeze solidified, a material in a molten state is newly supplied on the surface of the thin layer which is still in a molten state or in a semisolidified state. In the other case of the methods, after the supplied material in a molten state is perfectly freeze solidified and a thin film in a solidified state has been formed, the surface of the thin film is remelted by an appropriate heating means, and a material in a molten state is newly supplied onto this thin film surface in a molten or semisolidified state to form the next thin film. When a thin film is newly laminated on the underlying thin film which has already freeze solidified and completed solidification, as a means for remelting the underlying thin layer surface, such a method is also possible that the thin layer surface once freeze solidified is melted by generating friction heat with a pressing means advancing at a high speed. Also, in the case when the cooling rate is not made so large melting by the heating with the molten material supplied on the solidified thin layer is also possible. Furthermore, in a case when a large sized member is produced, it is also possible to effect the heating by use of a high temperature plasma laser, etc. Also, various kinds of melting methods as described above may be combined. However, in any case, the heating is required to limit to the thin layer surface positioned as low as possible, and as quickly as possible. Otherwise, arrangement of the underlying material having controlled arrangement is broken and the effect is reduced. Also, in the lamination with the upper layer, the heating of the inside is meaningless, since the atomic junction is only effected in an extremely thin layer.

The method for producing a reinforced block material according to the present invention is as described above. In the following, the process of the growth of the reinforced block material will be explained by referring to drawings.

Figure 2:
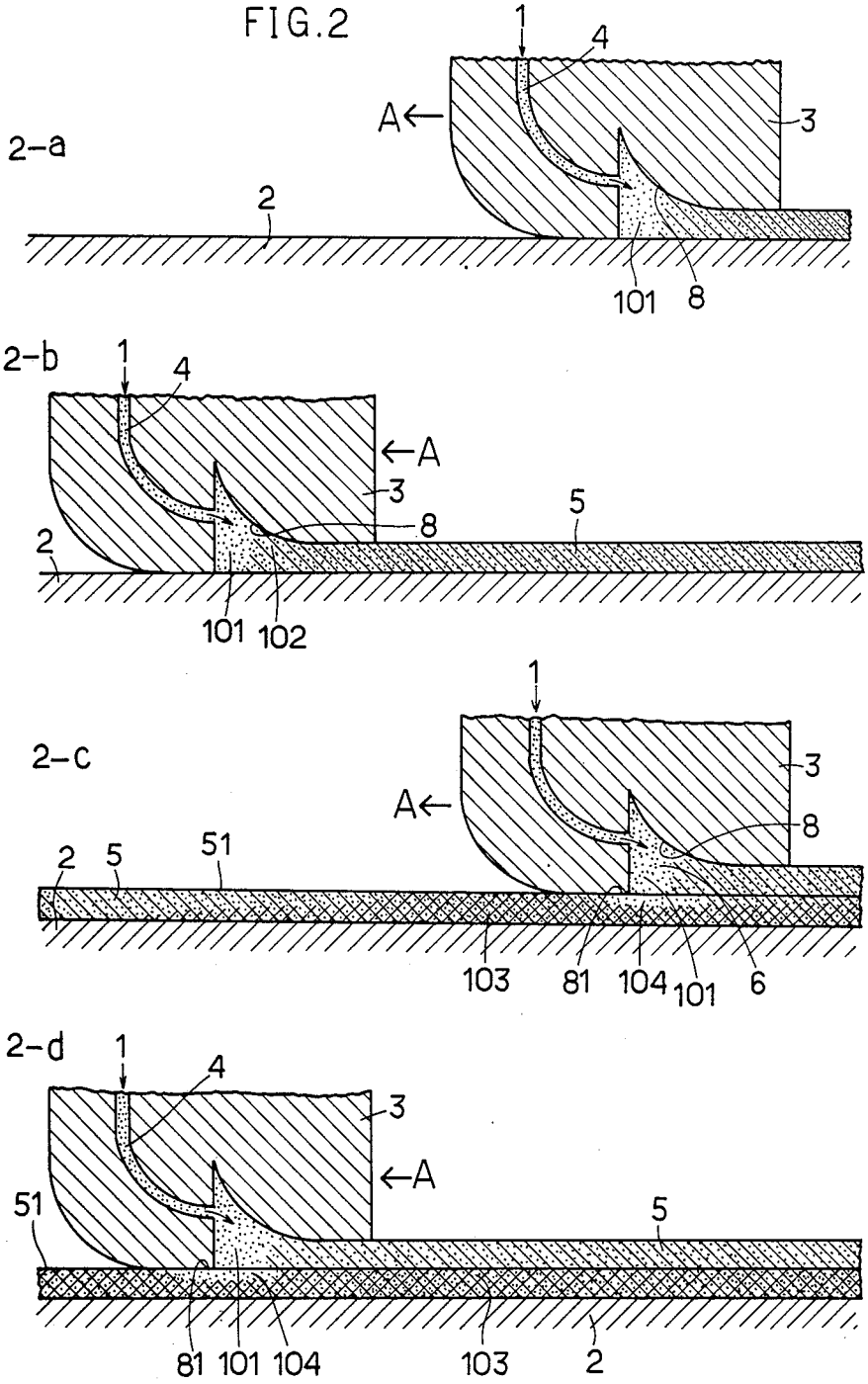

In the present invention, as shown in FIG. 1 or FIG. 2, a crystalline material 1 such as a metal or the like is previously made in a molten state 101 and then, it is continuously supplied from the material supplying path 4 onto a base material 2. To the material 1 in a semisolidifying state 102, while rapidly dissipating heat in the direction of the base material 2, high pressure and large shearing force are given by a pressing member 3 as a pressing means to give large deformation to the material 1, and thus, by laminating it in a thin film form, a thin film 5 of the reinforced material is formed on the base material 2. On this thin film 5, a material in a molten state is further supplied, and in the same manner as described above, a thin film 5 is formed to be laminated unitedly. By repeating such steps, a multiplicity of thin films of the reinforced material are formed as a whole to give a block material.

In the process as described above, the method of forming a material 1 in a semisolidified state in a thin layer-like form and giving thereto high pressure and large shearing force is, as shown in the figure, continuously supplies the material 1 in a molten state 101 from the material supply path 4 to the pressing member 3, and together with that, when the pressing member 3 is displaced on the base material 2 in the advancing direction A, while keeping a gap between it and said base material 2, the molten material 1 continuously supplied from the supply path 4 is laminated on the base material 2 in a thin layer form, and together with that, it begins to solidify while rapidly dissipating heat to the base material 2. This solidifying material 1 is subjected to high pressure from said pressing surface 8 by being pushed into the pressing surface 8 formed in a taper-like or curved form from the advancing direction toward the backward lower side accompanying to the displacement of the pressing member 3, together with that, it is subjected to the shearing force due to the displacement of the pressing member 3.

Also, in the present invention, in order to make both of the thin films 5, 5 adjoining in the up and down sides mutually united, in the molten or semisolidified state of the thin film surface 51 positioned in the lower layer, the material is newly supplied on said thin film surface 51 and laminated in a thin layer form to form the film 5 of the upper layer, and thus, both layers 5, 5 adjoining in the up and down sides are united. As the state of the thin film surface 51 positioned in the under layer in the time of this thin film lamination, there are the following two cases. That is, in one case, the thin film surface 51 is in a molten state or in a semisolidified state, before the thin film surface of the under layer perfectly solidifies, a thin film is formed on said surface 51. In another case, the thin film surface 51 of the under layer in which solidification has completed is reheated to make said surface be in a molten or semimolten state and the next new thin film 5 is formed thereon. In the former case, as shown in FIG. 1, the material is supplied on the base material 2, and in a state where it is under solidification while rapidly dissipating heat in the direction of said base material 2, large pressure and shearing force are given to the material with the pressing member 3 to let it be subjected to large deformation, and before the surface 51 of the material 1 being formed as the thin film 5 of the reinforced material perfectly solidifies, a material 1 in molten state is newly supplied onto the thin film surface 51 in said semisolidified state 102 to form a thin film form, and thus, the under layer thin film 5 and the thin film 5 formed on the surface thereon 51 are unitedly laminated. As the latter method, as shown in FIG. 2, the upper surface 51 of the thin film 5, which has been formed as a reinforced material by being laminated on the base material 2 and subjected to large deformation by the large pressure and large shearing force by the pressing member 3 while dissipating heat in the direction of said base material 2 to be cooled and solidified, is rubbed, for example, as shown in the figure, by the friction part 8 provided in the front side part of the material supply space 6 in the pressing member 3, the thin film surface 51 already in a solidified state is rubbed accompanying to the displacement of the pressing member 3, and by the friction heat generated in rubbing, the underlying thin film surface 51 is again brought into a molten or semimolten state 104. On the thin film surface 51 in the molten or semimolten state 104, is newly supplied a molten material 1 to form a thin film, and thus, both films 5 and 5 adjoining up and down are united. In melting the above-described thin film surface 51 in a solidified state 103, other than the method of utilizing the friction heat as described above, such a method may also be used that the thin film surface 51 is made in a molten or semi-molten state 104 by a heating means (not shown in the figure) such as a plasma laser provided at the position 81.

By repeating the steps such as described in 1-*c*, 1-*d*, in FIG. 1, or 2-*c*, 2-*d* in FIG. 2, and by forming a multiplicity of reinforced thin films 5, as a whole on a base material 2, a crystalline material such as a metal or the like is grown to form a block-like product.

In the steps shown in the above-described FIG. 1 or FIG. 2, although the case of assembling materials in molten state to be united by laminating one by one layer into a thin film-like product has been explained, in the following, the case of continuously affecting such steps will be explained by referring to FIGS. 3 and 4.

In order to carry out the production of reinforced materials in the present invention continuously, the pressing member 3 as a pressing means is formed in such a manner as, for example, illustrated in the figures, and a material supply space 6 is formed to be communicated to the material supply path 4 for continuously supplying crystalline material 1 previously made in a molten state 101, and the front side of the outlet of the above-described supply path 4 in said supply space 6 is formed in such a manner as to be curved in the rear downward to the advancing direction (A) of the pressing member or to be made in a taper-like form. A multiplicity of unit pressing parts having such pressing surface 8 are arranged in parallel in a transverse direction.

In order to form a reinforced block material of a crystalline material on a base material 2 by use of such a pressing member 3 as described above, the material 1 previously made in a molten state 101 is continuously supplied from each supply path 4 to each material supply space 6, and together with that, the pressing member 3 is displaced towards the advancing direction (A). At the same time with the displacement of this pressing member 3, the base material 2 is lowered to the down side (in the direction of the arrow (B) in the figure), thus the material 1 in a molten state 101 continuously supplied into the supply space 6 is formed as a multilayered body of declined thin films 5 on the base material 2.

The multilayered thin film body 5 rapidly dissipates heat to the direction of the base material 2 at the same time as it is formed to become solidified and together with that, is subjected to large deformation by the high pressure and large shearing force given by the pressing surface 8 of each pressing member 3 to be formed as the thin film body of the reinforced material. Respective thin films 5 are regulated in such a manner that, as shown in FIG. 3, before the thin film surface 51 positioned in the front side of the advancing direction (A) to each pressing part dissipates heat and perfectly solidifies, the displacing speed of the pressing member 3, the supply speed of the material 1, and descending speed of the base material 1 are regulated.

Figure 3:
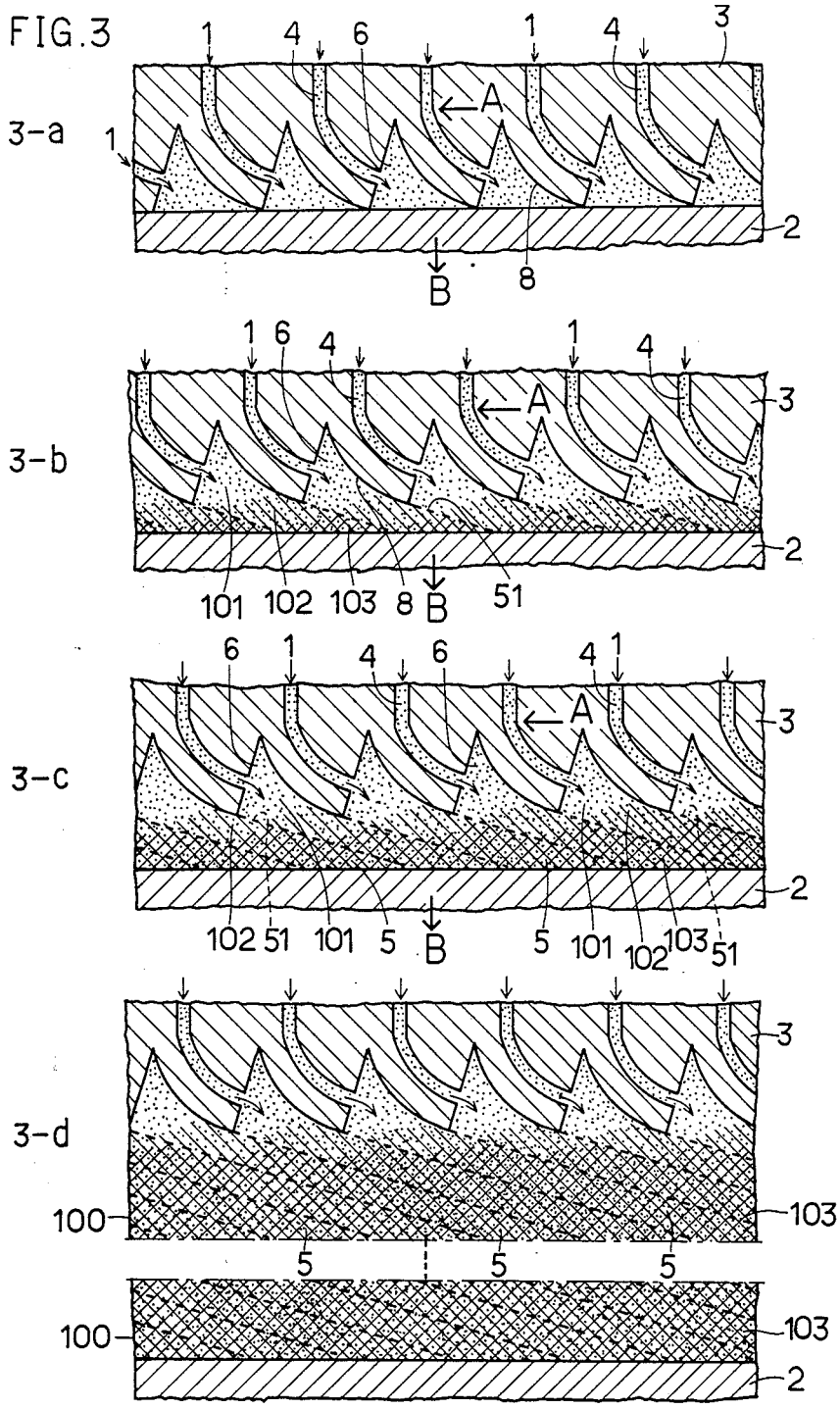
FIGS. 3*a*–3*d* and 4*a*–4*d* are process explanatory diagrams show the processes for forming a reinforced block material in the case of continuously carrying out the above-described production method.

The newly supplied material 1 is laminated on the surface 51 in a semisolidified state 102 of the adjoinning thin film 5 and the both thin films adjacently formed become united and each thin film is undistinguishable, and in such a manner, a block body grows (FIG. 3, 3-*d*).

Figure 4:
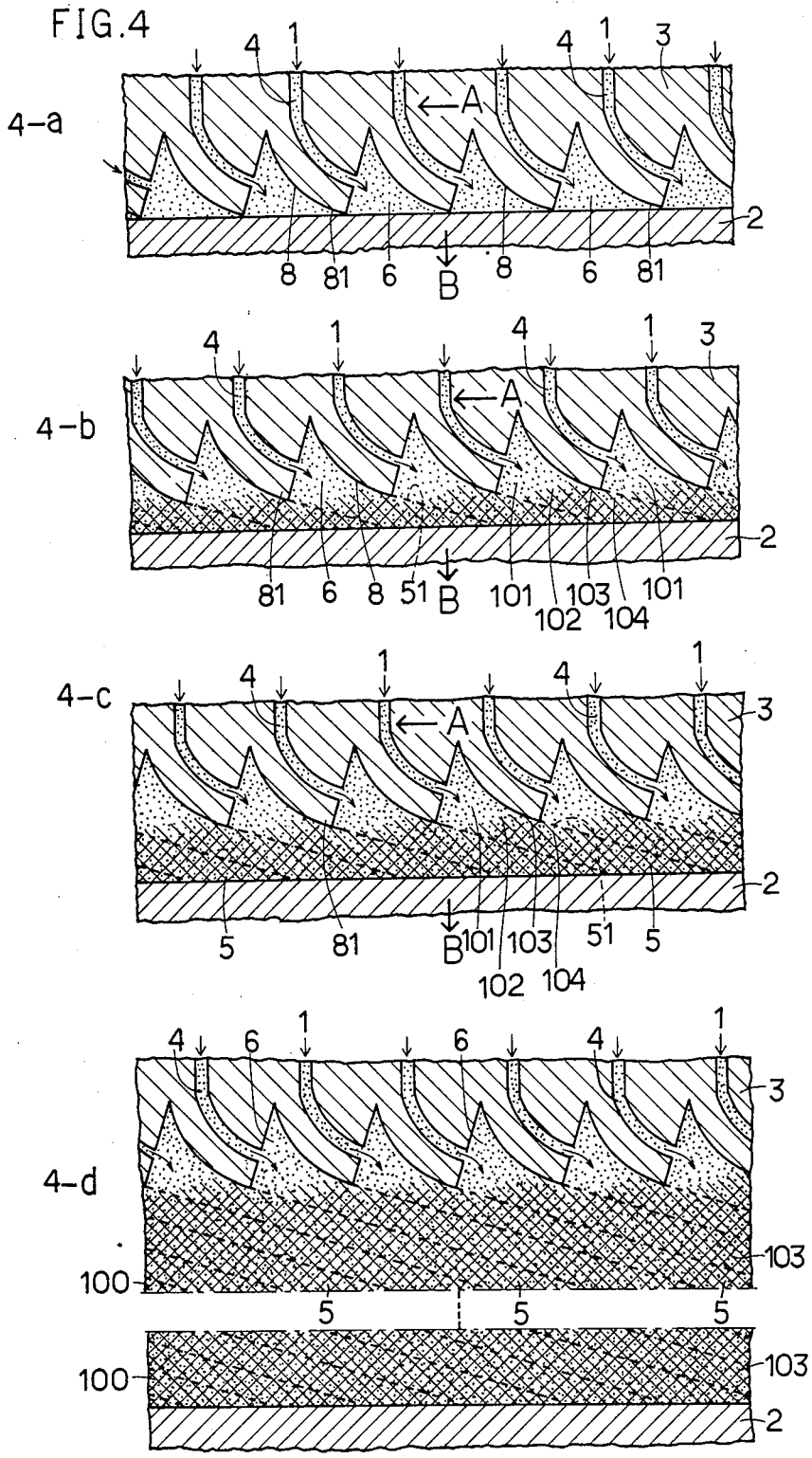

Also, as shown in FIG. 4, after the thin film 5 positioned in the front side of the advancing direction (A) of the pressing member 3 to each thin film 5 has perfectly solidified 103, and the molten material 1 newly supplied into the supply space 6 of the pressing part positioned in the rear side thereof is to be laminated, the thin film surface 51 is brought into a molten or semimolten state 104 again by the friction heat generated by the friction of the rear end lower part 81 of the pressing part positioned in the front side to the solidified thin film surface 51. By laminating the molten material 1 supplied into the supply space 6 of the adjoining pressing part to this thin film surface in a molten or semi-molten state 104, the adjoining respective thin films 5 are unitedly formed, and by effecting the process continuously, thin films of the multi-layered reinforced material are unitedly formed on the base material 2, and grow into a block-like body (FIG. 4, 4-*d*).

In the procedures of FIGS. 1–4 described above, by making the pressing member 3 with a bad heat conductor such as a ceramic or the like, the material 1 in a molten state 101 supplied from the material supply source via supply path 4 dissipates heat toward the base material 2 or solidified part 103 of the thin film 5 positioned in the under layer and solidifies from the lower part in the thin film structure toward the upper part thereof, and also, the material 1 in a semimolten state 102 contacting the pressing surface 8 rapidly dissipates heat to the solidified part 103 or to the base material 2, and together with that, since it receives no supply of heat from the pressing surface 8, can maintain high cooling speed. Also, in the examples shown in FIGS. 3 and 4, together with that the pressing member 3 is displaced to the advancing direction (A), the base material 2 is lowered downward (B), and thereby, a reinforced thin film body is formed in the space between the base material 2 and the pressing member 3. In this case, by displacing the base material 2 and the pressing member 3 relatively, a reinforced block material may be formed and let to grow between both members, so that it is also suitable that the base material 2 is kept fixed and the pressing member 3 is displaced to the advancing direction (A) and upward together.

In the above-described procedures, the solidified part 103 plays the role of a kind of plug to let the semimolten part 102 maintain a predetermined internal pressure otherwise cracks and pores are generated in the part in a semimolten state. Under deformation at the front side of the pressing surface 8, less sliding occurs between the pressing surface 8 and the semisolidified part 102.

Also, it is more favorable that the solidified part 103 is cooled from the outside, since the heat absorbing ability is kept constant by the heat conduction in the pressing surface 8 of the pressing member 3.

Further, the material 1 supplied from the supply source in a molten state 101 is preferably supplied to the pressing surface 8 at a temperature near the solidification point.

Also, in the above-described production procedure, although the production efficiency is improved in dependence to the increase of the supply amount of the molten material 1 supplied per unit time, but on the other hand, the average residual heat amount in the semisolidified part 102 increases and the cooling rate lowers to promote the growth of the crystal grains of the reinforced material formed to result in the lowering of the strength of the reinforced block material. Therefore, it is advantageous in respect to the reinforcement of the material to suppress the supply speed of the material to be low and the film thickness of a unit thin film to be thin. The preferably lowest limit of a thin film is about 50 to 100$\mu$, and the upper limit is about 200 to 500$\mu$.

Further, in FIGS. 1 to 4 described above, in order to explain the state in the thin film 5, although the thickness of the thin film 5 is illustrated as large in comparison to the size of the pressing member 3, but in practice, the thickness of the thin film 5 becomes considerably thin in comparison to the size of the pressing member 3. The reinforced block material to be formed in such a manner as described above comprises extremely thin films 5 formed with the material 1 in a molten state 101 which is supplied from the material supply source to the supply space 6 of the pressing member 3 via supply path 4. Since the material is rapidly cooled and subjected to the effects of miniaturisation of crystal grains, miniaturisation of segregated layers, widening of the solid solution limit, and the like, and together with that, it is also subjected to large deformation in a semisolidified state 102, the crystal grains are divided and miniaturised to be prevented from recrystallisation, and also, the unevenness of structure as seen in a general casting process and the occurrence of shrinkage cavities and minute pores are prevented, so that a good reinforced material can be obtained. In the case of laminating respective thin films, when the thin film surface 51 is in a molten state 101 or in a semimolten state 104, a new molten material 1 is laminated on said surface 51, so that the adjoining respective thin films 5, 5 become undistinguishable and are unitedly formed as a reinforced block material.

Figure 5:
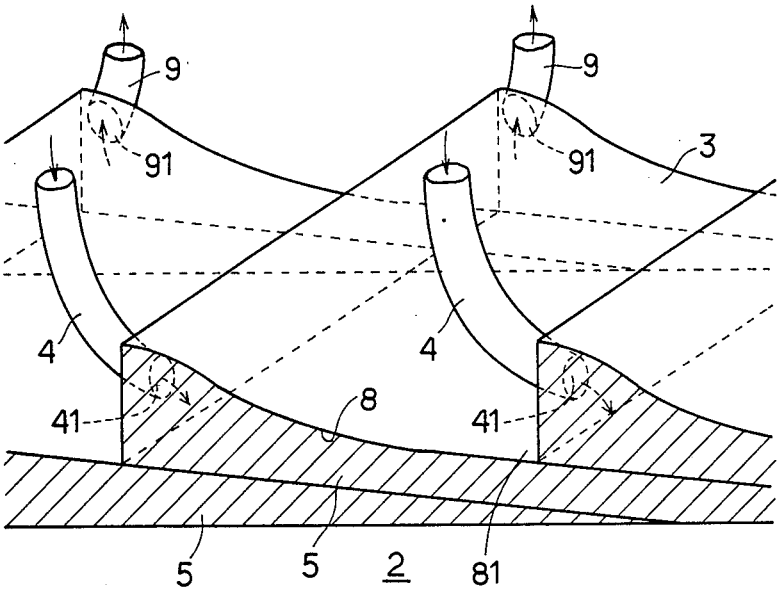
FIG. 5 is an enlarged explanatory diagram showing the main parts of an example of the pressing part in FIGS. 3 or 4.

Further, in the pressing member 3, as shown in FIG. 5, by providing other than the material supply outlet 41 provided at the position facing to the pressing surface 8, the discharge outlet 91 and discharging path 9 for discharging excessively supplied material discharged from the supply space 6 are provided in order that the amount of material 1 for use in thin film formation is made constant, and together with that, the gas contained in the molten material or the gas evolved when the molten material solidifies are discharged together with the excess material from the discharge outlet 91 via discharge path 9 from the supply space 6 to the outside, and further surely prevent the occurrence of a cavity due to the gas in the reinforced block material. However, in the case of a material accompanying no evolution of gas, the discharge outlet 91 and discharge path 9 for gas discharging use as described above are not necessarily required, so that the material 1 necessary for forming thin films may be supplied from the supply path 4 to the supply space 6.

Figure 6:
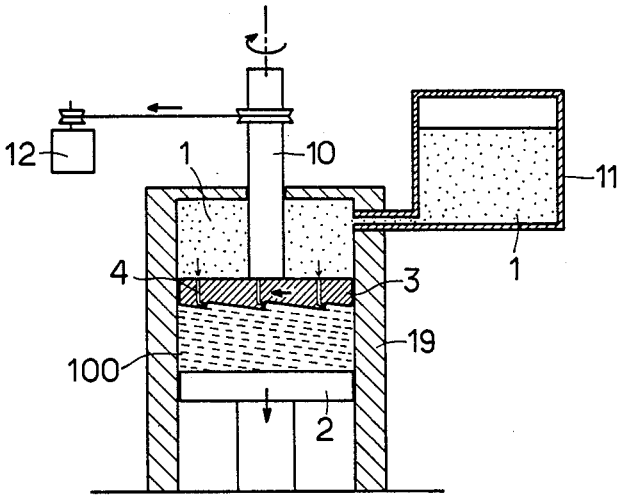
FIG. 6 is a side sectional explanatory diagram showing an example of the concrete device for effecting the production method according to the present invention.

As equipment for concretely effecting the above-described procedures for continuously molding reinforced block materials can be cited the following one in which, for example, as shown in FIG. 6, in a cylinder-like base body 19, a base material 2 is provided in which the upper surface is made like a circular plate and able to descend downward, and at the upper part of said base material 2 is provided a pressing member 3 rotatable in the base body 19 related to the driving means 12, and together with that, the material 1 previously made in a molten state in the material supply source 11 is introduced onto the above-described pressing member 3, and while continuously feeding the material from the material supply path 4 provided in said pressing member 3 onto the base material 2, the pressing member 3 is rotated and at the same time the base material 2 is let to descend, thus, thin films are spirally laminated on the base material 2 and unified reinforced block materials 100 can be continuously molded on the base material 2.

The shape of the block material 101 molded in such a manner as described above depends on the shape of the base material 2, and by making the shape of the base material square, circular, or ring-like, block materials 100 having respective shapes such as rectangular parallelepiped, cylindrical, or tubular shape can be obtained. For example, in FIG. 6, the shape of the reinforced block material 100 molded on the circular plate-like base material 2 becomes cylindrical, and when an equipment as shown in FIG. 7 is used, a rectangular parallelepiped shaped reinforced block material 100 can be obtained.

Figure 7:
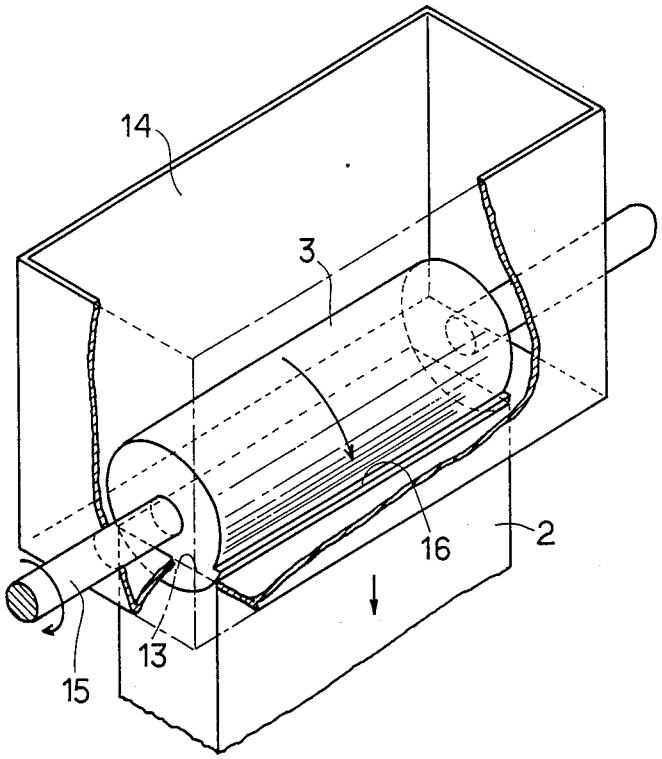
FIG. 7 shows a partially sectional perspective wiew showing the example of another device.
Figure 8:
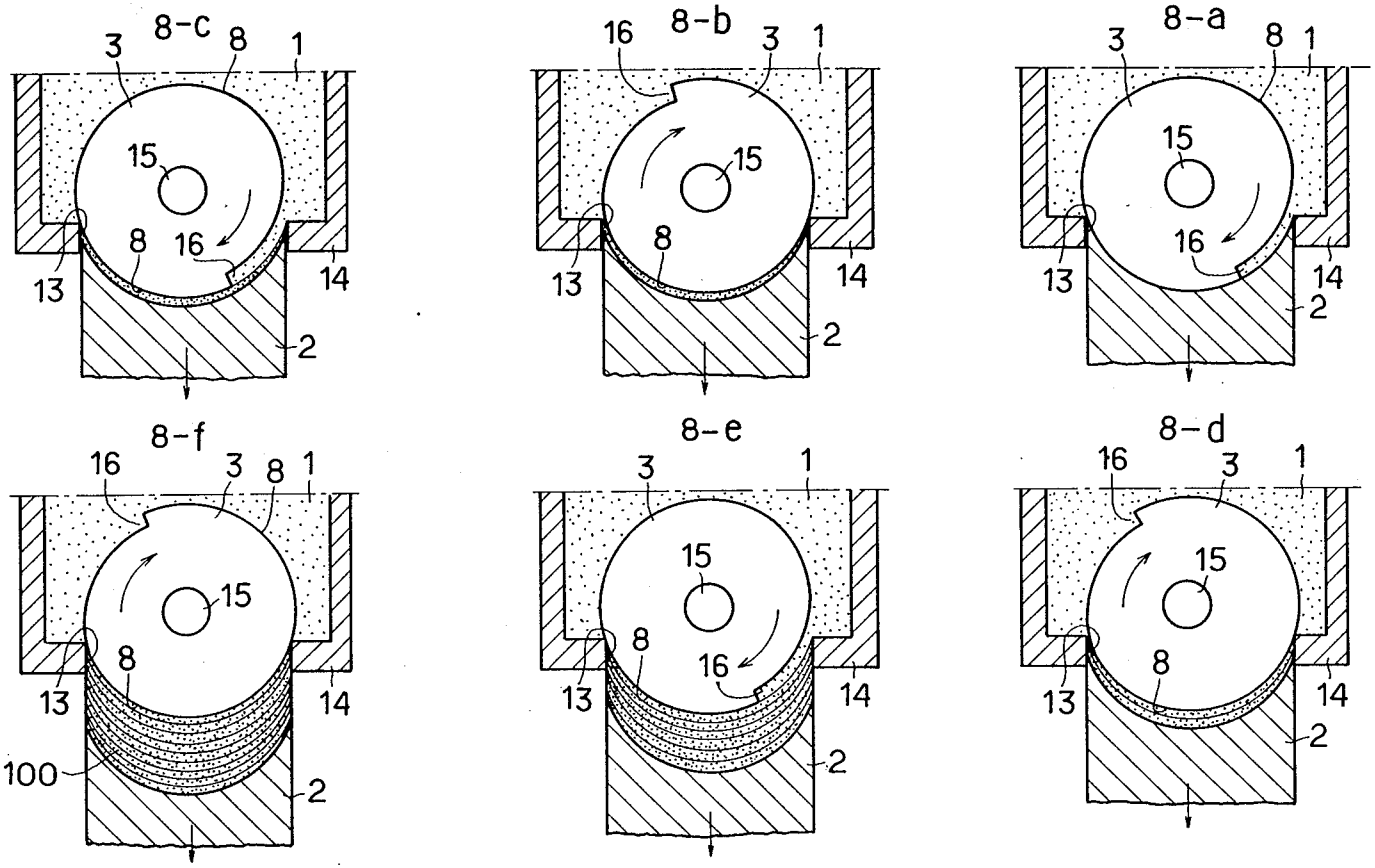
FIGS. 8*a*–8*f* are process explanatory diagrams of the production process of a reinforced block material in the device of FIG. 7.

In the equipment as shown in FIG. 7, a part of the pressing member 3 having a thrown-down cylinder shape and in which a concave part 16 as a material supply space is formed in the peripheral surface thereof as a pressing surface is inserted in the opening 13 of a material melting tank 14 provided with a rectangular opening 13, with the rotation axis 15 thereof being provided in the center as to be rotatable, and together with that, in the peripheral under surface facing to the opening 13 of said pressing member 3, is provided with a base material 2 in which the shape of the upper surface has been concaved into a shape capable of attaching to the peripheral surface of the above-described pressing member 3. The procedures for molding a reinforced block material 100 by means of equipment as described above will be explained by referring to FIG. 8.

Figure 9:
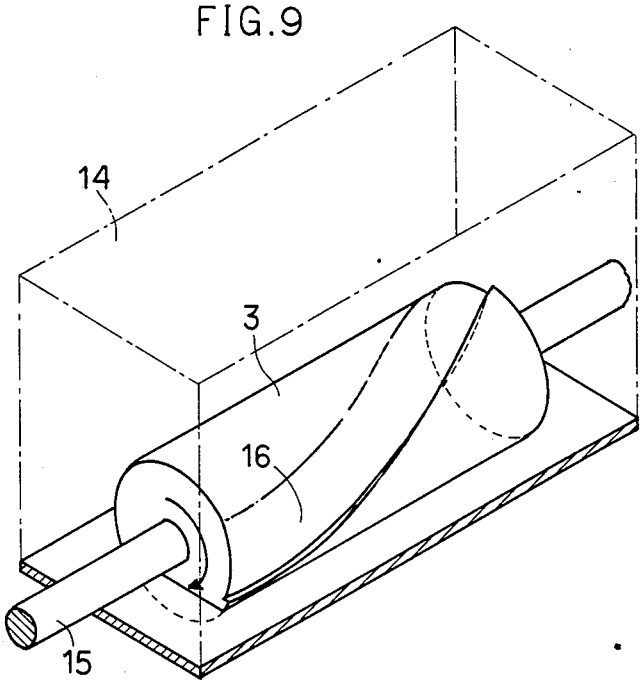
FIGS. 9 and 10 are the perspective view and side sectional view showing examples of the pressing members in FIG. 7.
Figure 10:
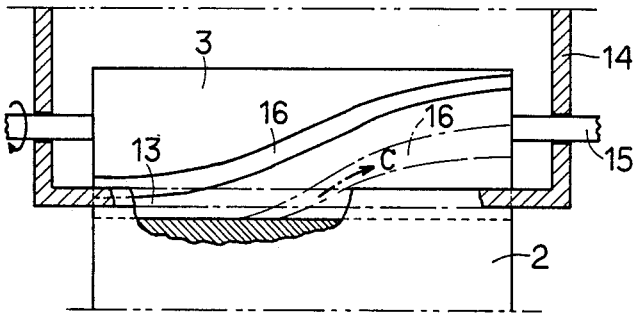

By rotating the pressing member 3, the molten material 1 melted in the above-described melting tank 14 is introduced into the gap formed between the pressing member 3 and the concave part on the upper surface of the base material 2 by the concave part 16 as a supply space provided on the peripheral surface of said pressing member 3 to laminate the material 1 on the upper surface of the base material 2 in a thin film-like form, and at the same time, large pressure and large shearing force are given thereon by the peripheral surface of the pressing member 3, thus, by giving large deformation in a semisolidified state to the material 1 dissipating heat in the base material direction and solidifying it, the thin film 5 of the reinforced material is formed. The base material 2 is descended until this thin film surface 51 has perfectly solidified, and together with that, a new thin film is formed on said thin film surface 51 by rotating the pressing member 3, or the thin film surface 51 once perfectly solidified and formed as a reinforced thin film is remelted by the friction heat generated in the friction with the peripheral surface of the pressing member 3 due to the rotation movement of the pressing member 3, or by use of a suitable heating means (not shown in the figure). On the remelted thin film surface 51 being in a molten state or in a semimolten state, a new thin film is formed to be united with the thin film 5 positioned in the under layer thereof. By repeating such procedures as described above, flat square form reinforced block materials are continuously produced. In such equipment as described in FIG. 7, as shown, for example, in FIGS. 9 and 10, by providing a concave part 16 as the material supply space provided in the peripheral surface of the pressing member 3 along the peripheral surface in spiral-wise, the gas contained in the material 1 supplied onto the surface of the base material 2 with the concave part 16 by the rotation of the pressing member 3 displaces from one side to another side thereof (as shown with an arrow C) and is discharged from the concave part 16 into the melting tank 14, thus, the occurrence of a cavity in the molded material can be prevented.

We claim:

1. A method for producing a crystalline reinforced block material, wherein a crystalline material in molten state at a high temperature is laminated in thin film form on a base material, and while dissipating heat in the direction of said base material and rapidly cooling said crystalline material, simultaneously applying high pressure and large shearing force to said crystalline material by a pressing means to cool and solidify said crystalline material into a thin film form on said base material to provide an underlying thin layer, and further laminates of said crystalline material in molten state at a high temperature are further laminated in a thin film form on said underlying thin layer surface in molten state or semisolidified state, one film after the other on the immediately proceeding laminated thin layer and while dissipating heat in the direction of said underlying thin layer to rapidly cool the crystalline material, high pressure and large shearing force are simultaneously applied to said crystalline material being laminated to cool and solidify said crystalline material into a thin film form on said immediately proceeding laminated thin layer to unite, cool and solidify said applied laminate and form a block body of said crystalline material on said base material.

* * * * *